US005741352A

United States Patent [19]

Ford et al.

[11] Patent Number: 5,741,352

[45] Date of Patent: Apr. 21, 1998

[54] AIR CLEANER

[75] Inventors: Joseph E. Ford, Cary; Donald N. Jursich, Chicago, both of Ill.; Raymond Chan, Vancouver, Canada

[73] Assignee: Jing Mei Industrial Holdings, Ltd., Cook Islands

[21] Appl. No.: 699,547

[22] Filed: Aug. 19, 1996

[51] Int. Cl.[6] ..... B03C 3/155

[52] U.S. Cl. ..... 96/68; 95/78; 96/69; 96/97; 96/99

[58] Field of Search ..... 96/15, 17, 65–69, 96/95–100, 77–79; 95/57, 78; 55/528, DIG. 39

[56] References Cited

U.S. PATENT DOCUMENTS

| | | | |
|---|---|---|---|
| D. 317,452 | 6/1991 | Garab | D14/250 |
| D. 321,885 | 11/1991 | Sheldrake | D14/253 |
| 2,453,192 | 11/1948 | Bryant | 55/523 |
| 2,538,419 | 1/1951 | Huston et al. | 379/437 |
| 3,108,865 | 10/1963 | Berly | 96/66 |
| 3,962,555 | 6/1976 | Efaw | 379/419 |
| 4,071,040 | 1/1978 | Moriarty | 137/199 |
| 4,357,151 | 11/1982 | Helfritch et al. | 96/66 X |
| 4,496,375 | 1/1985 | Le Vantine | 96/66 |
| 4,920,564 | 4/1990 | Allkins | 379/437 |
| 5,009,683 | 4/1991 | Sun | 96/66 |
| 5,025,921 | 6/1991 | Gasparaitis et al. | 206/320 |
| 5,055,115 | 10/1991 | Yikai et al. | 96/66 X |
| 5,133,788 | 7/1992 | Backus | 96/66 X |
| 5,220,598 | 6/1993 | Bock | 379/110 |
| 5,329,650 | 7/1994 | Zaccai et al. | 4/605 |
| 5,484,472 | 1/1996 | Weinberg | 96/69 X |

*Primary Examiner*—Richard L. Chiesa
*Attorney, Agent, or Firm*—Thomas W. Tolpin

[57] ABSTRACT

An attractive portable air cleaner effectively purifies air in a room or office for added comfort and a healthier environment. Instead of using expensive custom-made filters, the air cleaner uses regular toilet paper or paper towels for customer convenience and lower customer costs. A quiet blower system circulates air through the air cleaner. Ion emitters are positioned near the intake and collector plates support and charge the paper media.

5 Claims, 2 Drawing Sheets

AIR CLEANER

BACKGROUND OF THE INVENTION

This invention pertains to electronic air purifiers and, more particularly to air cleaners.

There are millions of people who are allergic to pollen, molds, dust, animal hair, etc. Allergy causing substances are typically very small particles, fibers, etc. which are circulated in the air both outside and inside, such as in offices, hospitals, schools, restaurants and homes. Allergic reactions frequently cause irritation and swelling of the sinus membranes, often making breathing more difficult and causing uncomfortable sinus drainage. The irritated membranes and sinus tissue which result from the allergic reaction can cause allergy patients to become more susceptible to other diseases, such as common colds, and may tend to exacerbate other health problems. Allergies are particularly aggravating to people trying to sleep.

Some conventional air cleaners function as electrostatic dust collectors. Dust and other substances in the air can be charged and attracted to the negative electrode near the outlet. Unfortunately, the charged particles are often not trapped but are discharged and scattered in the room to contaminate the surroundings with black soot or agglomerated carbon particles. Also, it is quite difficult to mechanically absorb and filter cigarette fumes and cooking oil mists since the sizes of the dust and mist are quite small and atomized.

Conventional electronic air cleaners often have dust collector electrodes arranged in parallel relationship to the air flow and have ion accelerating in front of the dust collector electrodes. In conventional air cleaners, dust in the dirty air is charged, attracted to and caught on the dust collector electrodes while passing between the dust collector electrodes and ion accelerating electrodes. Dust often adheres to the discharging wires and tends to decrease the efficiency and effectiveness of conventional air cleaner. If the dirty air includes cigarette fumes or oil mist from lard or salad oil, small particles of fume or oil often adhere and accumulate on the discharging wires and can clog the outlet of the air cleaner. Dust and other pollutants can cause similar problems.

Ions are particles that do not have a normal electric charge, having gained or lost an electron. A positive ion is a particle that has lost a negatively charged electron. Positive ions can be produced by cigarette smoke, dust, car exhausts and industrial pollution. A negative ion is a particle that has gained an extra electron. In the air, negative particles are generally oxygen atoms. Natural ions in the air are created by sunlight, moving air, and moving water, etc. which causes electrons to leave hydrogen and other atoms and couple themselves to oxygen atoms. Negative ions can help clean and freshen the air. The "smell" of the air after a rain shower is in part the result of negative ions created by the rain. The falling rain creates negative ions which help wash the air. Opens spaces promote naturally occurring negative ions to clean and freshen the air. The charged pollutants are attracted to the ground where they are harmlessly discharged.

In indoor environments, however the structures, that keep the healthful negative ions out, also keep the harmful positive ions in, and the pollutants with them. Tightly sealed houses and buildings aggravate the situation. Air conditioning won't solve the problem. It just cools the air that is already polluted and can destroy negative ions when air moves through the ducts.

Over the years many types of air filtering systems, air purifiers, ionizers and air cleaners have been suggested and have met with varying degrees of success. Conventional air filtering systems, air purifiers, ionizers and air cleaners are often cumbersome, complex, difficult to maintain and expensive. They can readily become clogged and have a high frequency of repairs.

It is, therefore, desirable to provide an improved air cleaner which overcomes most, if not all, of the preceding problems.

SUMMARY OF THE INVENTION

An attractive convenient air cleaner is provided to purify air in a room or office of a home, school, hospital, restaurant, or building. The user-friendly, environmentally correct, consumer responsive, air cleaner provides much cleaner air and a healthier and more comfortable environment for people, pets and plants. The beneficial inventive air cleaner also greatly reduces blotches of ugly black soot, debris and dirt formed by ionized particles, dust and agglomerated carbon particulates, from collecting on the exterior surface of the air cleaner, adjacent walls, ceilings, drapes, and furniture Advantageously, the portable skillfully crafted air cleaner is economical, easy to use, simple to operate, durable, efficient and effective. Desirably, the safe dependable air cleaner uses regular toilet paper or paper towels for customer convenience and lower costs maintenance instead of using expensive custom-made filters.

The well built, cost effective air cleaner has an ion emission assembly comprising ion emitting pins, needles, wires or other ion emitters to emit electronic (ions) in order to ionize influent air entering the air cleaner and the pollutants and contaminants carried by the air, such as dust laden particles and particulates of dust, pollen, smoke, soot and dirt. The easy-to-maintain air cleaner has paper media to collect the dust laden particles and particulates. A collector assembly, such as an imperforate collector plates, support and charge the paper media with a charge of opposite polarity to the ion emitters so that the paper media can attract and collect the charged ionized particulates. In the preferred form, the paper media plates and the paper media includes discardable paper which detachably covers at least part of, and preferably most of, the exterior surface of the collector plates. The discardable paper is easy to use and keeps the collector plates clean without any additionally cleaning or maintenance.

In the preferred form, the air cleaner has a negative ion generator comprising a high voltage negative power supply connected to the ion emitters and has a positive ion generator comprising a high voltage positive power supply connected to the collector plates. The air cleaner has a housing which safely encloses and prevents the ion emitters, ion generators and connecting ionizing circuitry from being accidentally touched, tampered with or exposed to water or moisture. The housing has an air intake for ingress of influent air laden with particulates and has an exhaust for egress of cleaner air having a substantially smaller concentration of particulates. The housing can have a ribbed cover with a set of inlet passageways comprising the intake. The ion emitters are positioned near and in proximity to the air intake to negatively charge the particulates being carried by the influent air. A blower assembly draws air into the intake, past the ion emitters and out through the exhaust. The exhaust can include a duct positioned near and in proximity to the blower assembly at a level below the paper media.

The new air cleaner has an ionizer that provides a negative charge to polarize air particles in a room and a positive charge to polarize a plate behind a filter medium. The ionizing air cleaner can be cylindrical in shape and can use standard toilet tissue or paper towels as the filter medium. The roll is advanced and severed as the filter becomes clogged with airborne particles.

In the new air cleaner, the ion generator is redesigned so that along with the high voltage negative power supply, a high voltage positive power supply is added. The new air cleaner places the negative ions on the intake side of the filter media. A high voltage charge is placed in front or behind the filter media. Particles entering the unit are negative charged, such as with 10–14 kilovolts. The negative charged particles are attracted to the positively charged filter media, such as at 10–14 kilovolts. The negative ions in the exhaust air are greatly reduced due to the attraction of the positively charged filter. This arrangement reduces and/or eliminate dust, pollen, smoke, etc. that is attracted to surfaces other than the filter media.

The air cleaner can be in at least two models. One model uses toilet paper rolls. The other model uses paper towel rolls. Based on the size of the cylinder, the customer can unroll enough paper to cover the collector plates. When replacement is needed, the customer can unroll additional sheets and tear off the dirty sheets.

The special air cleaner and process can greatly improve the efficiency of air purification. Because of the heavy positive charge, the airborne particles are attracted to the paper media without pushing the air through the paper. Desirably, the novel air cleaner reduces the static pressure on air moving systems for a particular flow rate. The novel design and arrangement also reduces the cost of the air moving system and extends the life of the motor of the blower assembly.

A more detailed explanation of the invention is provided in the following description and appended claims taken in conjunction with the accompanying drawings.

DETAILED DESCRIPTION OF THE PREFERRED EMBODIMENT

A compact portable air cleaner 10 provides an effective convenient ionizer, user-friendly device, light weight apparatus and attractive small personal appliance. The air cleaner plugs into an electrical power wall outlet of a room or office of a home, school, hospital, restaurant, or building. The air cleaner purifies, cleanses and dedusts airborne particulars (dust laden particles) of dust, pollen, smoke, soot, orders and other pollutants in the air to substantially decrease the amount and concentration of particulates and contaminants in the air in the room or office in which the air cleaner is operating so as to make the air in the room fresher, cleaner, healthier, more breathable and comfortable for persons, plants, pets and animals in the room or office. Desirably, the air cleaner greatly reduces the accumulation of dirt, soot, debris and particles on the walls, ceiling, floor, carpet, drapes, and furniture in the room or office where the air cleaner is located.

Figure 1:
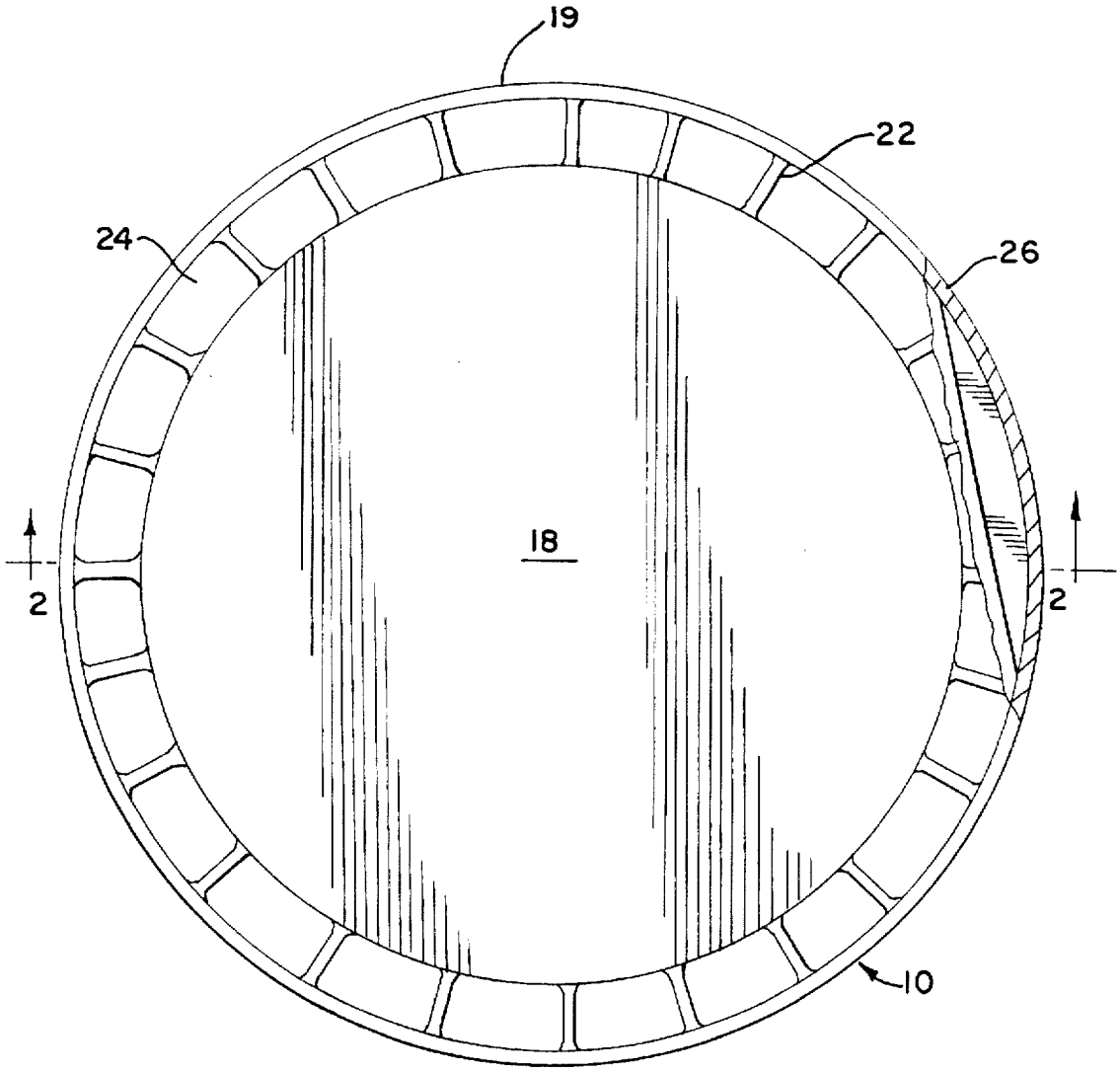
FIG. 1 is a top plain view of an air cleaner in accordance with principles of the present invention and showing a cutaway section for clarity and ease of understanding.
Figure 2:
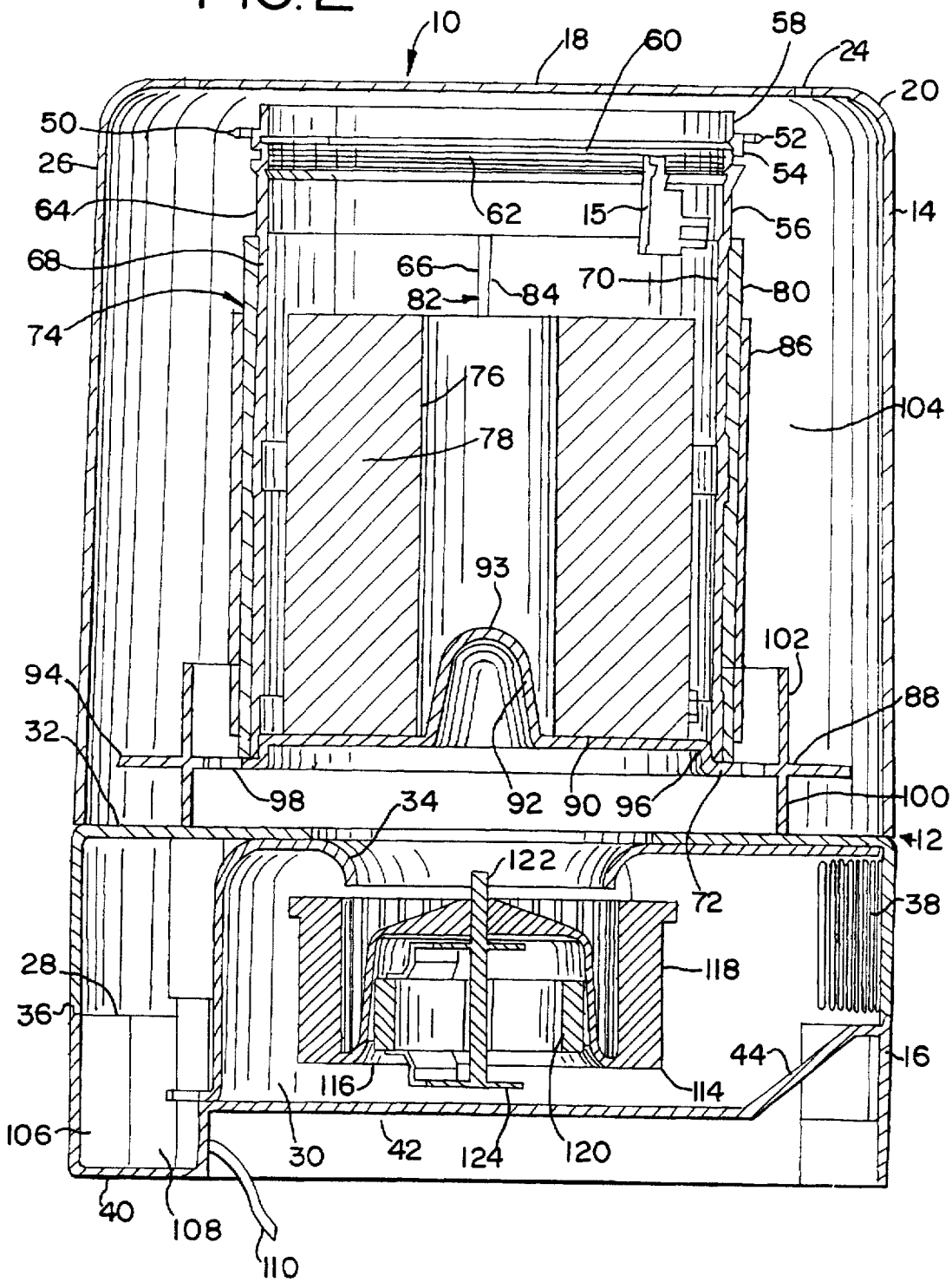
FIG. 2 is a cross-sectional front view of the air cleaner taken substantially along line 2—2 of FIG. 1.

The air cleaner has a housing 12 (FIG. 2) which provides a housing assembly and casing. The housing can be made of impact-resistant plastic or metal. The housing has an upper housing portion 14 with a lock 15 and a lower housing portion 16. The upper housing portion has a circular top 18 (FIG. 1) or disc which provides a cover with an outer rim 19 and has a rounded outer edge or corner 20 (FIG. 2). The top has a series, set or array of radial ribs 22 (FIG. 1) and a circular set of radial inlet passageways 24 between the ribs which provide an air intake for entrance of influent air laden with particulates of dust, pollen, smoke, soot or other pollutants. The upper housing portion also has a skirt 26 comprising an annular cylindrical or circular upright wall which extends integrally downwardly from the top.

The lower housing portion provides a base 16 (FIG. 2) which is positioned below and supports the upper housing portion. The base has one or more ion generator compartments 28 which are positioned in proximity and adjacent to a blower compartment 30. The base has an upper horizontal lid 32 which provides an upper base portion. The lid has a central upwardly diverging blower opening 34 or hole which communicates with the blower compartment and the upper housing compartment. The base has upright annular sidewalls 36 which extend internally downwardly from the lid. The upper portion of the side walls has an outlet blower opening 38 which provides an air exhaust and duct positioned in proximity to and communicating with the blower compartment. The bottom 40 of the base can comprise a stepped floor or raised section 42 with a sloped section which provides an inclined deflector 44 that extends upwardly from the raised section at the bottom of the blower compartment to the exhaust to direct air to the exhaust.

The interior of the air cleaner includes an ionizer assembly 50 with a circular array, set or series of negatively charged ion emitters 52 comprising ion-emitting pins or needles to emit ions, ionize the influent (incoming) air and negatively charge the particulates (particles) in the air. The ion emitters are positioned near and disposed in proximity to the air intake (inlet). Art upper emitter-support portion 54 of an ion emitter-support stand 56 can support the ion emitters. The ion emitters are circumferentially and aliquotly spaced from each other and extend radially outwardly from the upper emitter support portion. In the preferred embodiment, there are six ion emitters. In some circumstances, it may be desirable to use more or less ion emitters. The ion emitter-support stand can provide an upright tubular superstructure and can comprise an electrically insulating annular cylindrical shell 58 molded of rigid impact-resistant plastic. The shell has a horizontal annular or circular coil-support position 60 which extends below the upper emitter-support portion. An electrical wire coil 62 is wound around and positioned about the coil-support portion. The coil is connected to the ion emitters. The shell also has an upright elongated support portion 64 which provides a vertical tubular support wall that extends downwardly below the coil-supporting portion and coil. The support wall has one or more upright paper-dispensing slots 66. The support wall also has an outer collector plate-engaging surface 68, an inner paper roll-facing surface 70, and a bottom section 72.

The air cleaner further features a collector assembly 74 which comprise an upright roll 76 of disposable paper 78 to collect the ionized negatively charged particulates. For lower costs, convenience and ease of maintenance, the roll of paper preferably comprises toilet paper or paper towels. The roll of paper is peripherally and annularly surrounded by the shell and is positioned, disposed and spaced inwardly of the shell.

A pair of positively charged, diametrically opposite, imperforate, fluid impervious, liquid impermeable, curved collector plates 80 are positioned against and about the outer collector plate-engaging surface of the shell. Each of the collector plates are curved, rounded and arcuate with a convex exterior paper-supporting surface, which faces the housing, and a concave interior surface which abuts against and securely engages the collector plate-engage surface of the shell. The metal collector plates are circumferentially spaced from each other to provide a dispenser 82. The dispenser has upright dispensing openings 84 or slots which are aligned in registration with the upright paper dispensing slots 66 of the shell to dispense and pass paper from the roll onto the exterior paper-supporting surface of the collector plates. The dispensed paper includes a disposable paper portion 86 which detachably covers and is removably placed against most of the exterior paper-supporting surface of the collector plates. The paper portion 86 is positively charged by the collector plates to attract and collect the ionized negatively charged particulates (particles).

A paper roll-support stand 88 has a circular raised horizontal support platform 90 and an upwardly extending central spindle 92 with a rounded apex 93 to support the roll of paper. The paper roll-support stand has an annular flange 94 which provides a rim and extends radially outwardly of and at an elevation slightly below the platform 90. A circular shoulder 96 is positioned about and extends downwardly from an outer edge of the platform 90. The shoulder connects the rim 94 to the platform. The rim 94 abuttingly engages and supports the bottom section of the ion emitter-support stand at a position adjacent the shoulder. The rim has a set or array of air holes 98 or apertures which are positioned radially outwardly of the emitter-support stand and the collector plates and communicate with the blower opening 34. The paper roll-support stand also has an annular leg portion 100 which extends integrally downwardly from the rim at a location radially outwardly of the air holes 98. The leg portion 100 sits upon the lid of the base. An annular support wall 102 can extend integrally upwardly from the leg portion 100.

The collector plates are spaced away from and cooperate with the housing to provide an annular air passageway 104. The annular air passageway is positioned between and communicates with the air intake and the air holes of the rim. A negative ion generator 106 and a positive ion generator 108 are positioned in the ion generator compartments. The negative ion generator comprises a high voltage negative power supply which is connected to the ion emitters and coil to negatively charge the ion emitters with negative voltage, such as 10–14 kilovolts. The positive ion generator comprises a high voltage positive power supply connected to the collector plates to positively charge the collector plates and detachable paper with positive voltage, such as 10–14 kilovolts. A power cord 110 can be connected to one of the ion generators. The power cord has an outlet which plugs into an electrical socket in a room, office, building, etc.

An air blower 114 or air blower assembly is positioned in the blower compartment to draw air through the air intake 24 into the annular air passageway 104 past the ion emitters 52 and the positively charged paper portion 86 on the collector plates 80 and through the air holes 98 into the blower opening 34. The air blower blows and propels cleaner air through the exhaust 38 with a substantially lower concentration of particulates than the influent air entering the intake of the air cleaner. The air blower can comprise an induction motor 116, such as 2, 4 or 6 pole multi-speed shaded motors. The air blower can have: a stator 118, a rotor 120 positioned within the stator, an upright vertical shaft 122 which rotates within and extends vertically through at least part of the rotor and stator. A blower wheel comprising a fan 124 with fan blades extends below and is connected to the shaft. The fan communicates with the blower opening and the exhaust to blow cleaner air through the exhaust and out of the air cleaner. The motor is connected by wires and circuitry to the power supplies, power cord coil and ion emitters.

Among the many advantages of the air cleaner are:

1. Outstanding performance.
2. Superior quality.
3. Excellent air purification.
4. Beneficial to the environment.
5. Simple to install.
6. Easy to use with low cost toilet paper and paper towels.
7. Can be readily mass produced.
8. Cleaner living space.
9. A healthier environment for people, plants and pets.
10. Superb removal of pollutants and contaminants.
11. Decrease of dust and dirt.
12. Convenient.
13. Attractive.
14. Economical.
15. Reliable.
16. Efficient.
17. Effective.

Although embodiments of the invention have been shown and described, it is to be understood that various modifications and substitutions, as well as rearrangements of parts, components, and process steps, can be made by those skilled in the art without departing from the novel spirit and scope of this invention.

What is claimed is:

1. An air cleaner, comprising:

a housing providing a casing with an upper housing portion and a lower housing portion, said upper portion having a substantially circular top providing a cover and a skirt comprising an annular wall extending integrally downwardly from said top, said top having a series of radial ribs and defining a substantially circular set of radial inlet passageways between said ribs providing an air intake for entrance of influent air laden with particulates of dust, pollen, smoke, soot or other pollutants, said lower housing portion providing a base positioned below and supporting said upper housing portion, said base having at least one ion generator compartment and a blower compartment positioned in proximity to said ion generator compartment, said base having an upper lid defining a blower opening communicating with said blower compartment and said upper housing compartment, said base having sidewalls extending integrally downwardly from said lid and a duct defining an outlet opening providing an air exhaust in proximity to said blower compartment;

an ionizer assembly comprising a circular array of negatively charged ion emitters comprising ion-emitting pins or needles for emitting ions to ionize said influent air and negatively charge said particulates;

said ion emitters being disposed in proximity to said intake, an upright tubular superstructure comprising an electrically insulating rigid plastic annular shell providing an ion emitter-support stand, said shell having an upper emitter-support portion for supporting said ion emitters, said ion emitters being circumferentially and aliquotly spaced from each other and extending radially outwardly from said upper emitter-support portion, said shell having a substantially horizontal annular coil-support portion extending below said upper emitter-support portion, an electrical coil positioned about said coil-support portion and connected to said ion emitters, said shell having an upright elongated support portion extending downwardly below said coil-support portion, said upright support portion defining at least one upright paper-dispensing slot and having a bottom section and said upright support portion having an outer collector plate-engaging surface and an inner paper roll-facing surface;

a collector assembly comprising an upright roll of disposable paper for collecting said negatively charged particulates, said roll of paper being peripherally and annularly surrounded by said shell and being disposed inwardly of said shell, positively charged curved collector plates positioned against said outer collector plate-engaging surface of said shell, said collector plates comprising diametrically opposed imperforate fluid-impervious metal collector plates, each of collector plates being arcuate with convex exterior paper-supporting surface facing said housing and a concave interior surface abutting against and securely engaging said collector plate-engaging surface of said shell, said collector plates being circumferentially spaced from each other to provide a dispenser defining an upright dispensing opening aligned in registration with said upright paper-dispensing slot of said shell for dispensing and passing paper from said roll onto said exterior paper-supporting surface of said collector plates, said dispensed paper including a paper portion detachably covering a substantial portion of said exterior paper-supporting surface of said collector plates and said paper portion being positively charged by said collector plates for attracting and collecting said negatively charged particulates;

a paper roll-support stand comprising a substantially circular raised support platform and an upwardly extending spindle with a rounded apex for supporting said roll of paper, said paper roll-support stand having an annular flange providing a rim extending radially outwardly of and at an elevation slightly below said raised support platform, a substantially circular annular shoulder positioned about and extending downwardly from an upper edge of said raised support platform, said shoulder connecting said raised support platform, said shoulder connecting said rim to said raised support platform, said rim abuttingly engaging and supporting said bottom section of said ion emitter-support stand at a position adjacent said shoulder, said rim defining a set of air holes positioned radially outwardly of said emitter-support stand and said collector plates for communicating with said blower opening, said paper roll-support stand having an annular leg portion extending integrally downwardly from said rim at a location radially outwardly of said holes for seating upon said lid of said base, and an annular support wall extending upwardly from said leg portion;

said collector plates being spaced from and cooperating with said housing to define an annular air passageway positioned between and communicating with said intake and said air holes of said rim;

a negative ion generator and a positive ion generator disposed in said ion generator compartment, said negative ion generator comprising a negative power supply connected to said ion emitters, and said positive ion generator comprising a positive power supply connected to said collector plates;

an air blower assembly positioned in the blower compartment for drawing air through said intake into said annular air passageway past said ion emitters and said positively charged paper portion on said collector plates and through said air holes into said blower opening and for blowing cleaner air having a substantially lower concentration of particulates than said influent air through said exhaust, said blower assembly comprising an induction motor having a stator, a rotor positioned within said stator, an upright shaft rotatably disposed within and extending substantially vertically through at least part of said rotor and stator, and a blower wheel comprising a fan extending below and connected to said shaft and communicating with said blower opening and said exhaust for blowing cleaner air through said exhaust out of said air cleaner.

2. An air cleaner in accordance with claim 1 wherein said base includes an inclined deflector extending upwardly from a level below said fan to said exhaust for directing air to said exhaust.

3. An air cleaner in accordance with claim 1 wherein said motor is a multi-speed shaded pole motor.

4. An air cleaner in accordance with claim 1 wherein said paper comprises paper towels.

5. An air cleaner in accordance with claim 1 wherein said paper comprises toilet paper.

* * * * *